United States Patent [19]

Anderson

[11] 4,346,690

[45] Aug. 31, 1982

[54] CD IGNITION WITH ISOLATION CIRCUIT TO PROVIDE IMMEDIATE RECHARGING OF THE CHARGE CAPACITOR

[75] Inventor: Philip A. Anderson, Waukegan, Ill.

[73] Assignee: Outboard Marine Corporation, Waukegan, Ill.

[21] Appl. No.: 157,418

[22] Filed: Jun. 9, 1980

[51] Int. Cl.[3] ..... F02P 3/06

[52] U.S. Cl. ..... 123/599; 315/209 SC

[58] Field of Search ..... 123/599–602; 315/209 SC, 209 CD

[56] References Cited

U.S. PATENT DOCUMENTS

| | | | |
|---|---|---|---|
| 3,669,086 | 6/1972 | Beuk | 123/599 |
| 3,715,650 | 2/1973 | Draxler | 315/209 SC X |
| 3,729,647 | 4/1973 | Mainprize | 315/209 SC |
| 3,750,637 | 8/1973 | Minks | 315/209 CD X |
| 3,861,372 | 1/1975 | Shibukawa et al. | 123/599 |
| 3,898,972 | 8/1975 | Haubner | 123/599 |
| 4,232,646 | 11/1980 | Asai | 123/600 |

*Primary Examiner*—Tony M. Argenbright
*Attorney, Agent, or Firm*—Michael, Best & Friedrich

[57] ABSTRACT

Disclosed herein is a capacitor discharge ignition system comprising a charge capacitor, an ignition coil primary winding, an ignition SCR, and an isolation circuit connected in circuit with the charge capacitor, the primary winding and the ignition SCR. The isolation circuit preferably comprises a thyristor having an anode, a cathode, and a gate, and having an anode-cathode path connected in series relationship with the charge capacitor, and a parallel RC network having one end connected to the thyristor anode and having an opposite end connected to the thyristor gate. The isolation circuit is operative for selectively isolating the primary winding and the ignition SCR from the charge capacitor to provide for immediate recharging of the charge capacitor after the charge capacitor has discharged through the primary winding to effect an ignition spark.

12 Claims, 2 Drawing Figures

CD IGNITION WITH ISOLATION CIRCUIT TO PROVIDE IMMEDIATE RECHARGING OF THE CHARGE CAPACITOR

FIELD OF THE INVENTION

The invention relates generally to capacitor discharge ignition systems, and more particularly, to CD ignition systems with circuit arrangements to provide for faster recharging of the charge capacitor after an ignition spark.

DESCRIPTION OF THE PRIOR ART

Attention is directed to the following United States patents which disclose capacitor discharge ignition systems:

Minks—U.S. Pat. No. 3,750,637 issued Aug. 7, 1973;
Mainprize—U.S. Pat. No. 3,729, 647 issued Apr. 24, 1973;
Haubner—U.S. Pat. No. 3,898,972 issued Aug. 12, 1975;
Beuk—U.S. Pat. No. 3,669,086 issued June 13, 1972;
Draxler—U.S. Pat. No. 3,715,650 issued Feb. 6, 1973; and
Skibukawa et al—U.S. Pat. No. 3,861,372 issued Jan. 21, 1975.

SUMMARY OF THE INVENTION

The invention provides an isolation circuit adapted to be connected in series relationship with an existing capacitor discharge ignition system. More particularly, the isolation circuit is adapted to be connected in series relationship with a charge capacitor, an ignition coil primary winding, and an ignition SCR of a CD ignition system. The isolation circuit is operative for selectively isolating the primary winding and the ignition SCR from the charge capacitor so as to provide for immediate recharging of the charge capacitor after the charge capacitor has discharged through the primary winding to effect an ignition spark. This immediate recharging results in the charge capacitor being fully charged in a shorter period of time after an ignition spark, relative to a CD ignition system without such a isolation circuit. Thus, a suitable voltage is maintained for an internal combustion engine turning at a relatively higher rpm. The invention is also useful to maintain a suitable ignition voltage for a multi-cylinder internal combustion engine having an ignition system driven by a single power supply.

The invention also provides a capacitor discharge ignition circuit which comprises a charge capacitor, an ignition SCR, and isolation circuit means adapted for connecting the charge capacitor and the ignition SCR in series relationship with an ignition coil primary winding. The isolation circuit means is operative for selectively isolating the charge capacitor from the primary winding and the ignition SCR to provide for immediate recharging of the charge capacitor after the charge capacitor discharges through the primary winding to effect an ignition spark.

The invention also provides a capacitor discharge ignition system which includes an ignition coil primary winding and a capacitor discharge ignition circuit with isolation circuit means as described above. In one embodiment of the invention, the isolation circuit means preferably includes an isolation circuit also as described above, and which preferably includes a thyristor which takes the form of a second or "isolation" SCR connected in series relation with the charge capacitor, the primary winding, and the ignition SCR. The isolation circuit also preferably includes a parallel RC network having one end connected to the anode of the isolation SCR and having the opposite end connected to the gate of the isolation SCR. The isolation SCR turns off or provides its function of isolating the charge capacitor from the primary winding and the ignition SCR when the charge capacitor discharges to near zero voltage, effecting an ignition spark. More specifically, the parallel RC network provides a back bias appearing on the capacitor of the RC network which clamps the thyristor off when the charge capacitor discharges to a point where the gate-cathode junction of the isolation SCR is reverse biased.

One of the principal features of the invention is the provision of an isolation circuit operative in connection with a capacitor discharge ignition system so that there is immediate recharging of the charge capacitor after the charge capacitor discharges to effect an ignition spark. Such immediate recharging results in the capacitor discharge ignition system maintaining a suitable magnitude ignition voltage at relatively higher engine rpm.

Another of the principal features of the invention is to provide such an isolation circuit which allows a single power supply to more effectively maintain suitable ignition voltage when used with a CD ignition system for a multi-cylinder engine.

Other features and advantages of the embodiments of the invention will become known by reference to the following general description, claims, and drawings.

Figure 2:
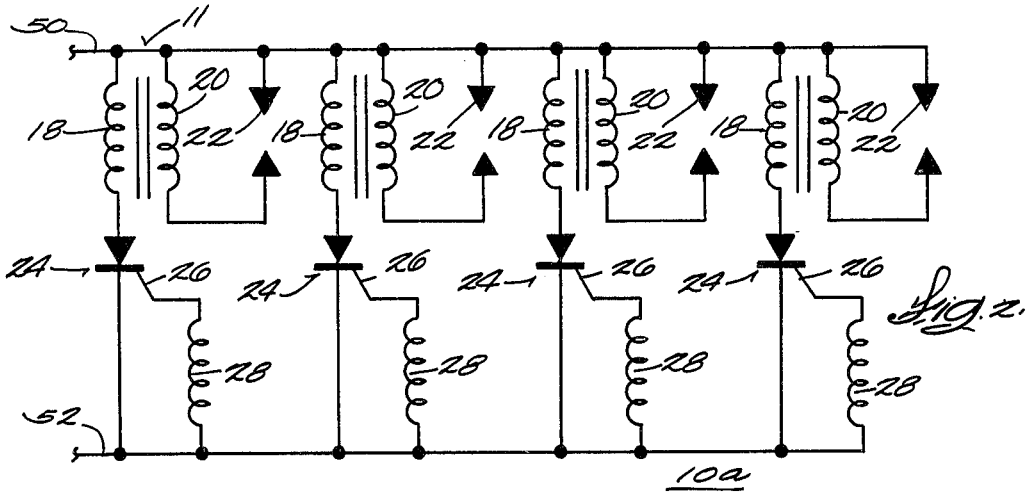
FIG. 2 is a schematic circuit of a portion of the capacitor discharge ignition system shown in FIG. 1, modified for use with a four cylinder engine.

Before explaining the embodiments of the invention in detail, it is to be understood that the invention is not limited in its application to the details of construction and the arrangement of components set forth in the following description or illustrated in the drawings. The invention is capable of other embodiments and of being practiced or carried out in various ways. Also, it is to be understood that the phraseology and terminology employed herein is for the purpose of description and should not be regarded as limiting.

GENERAL DESCRIPTION

Figure 1:
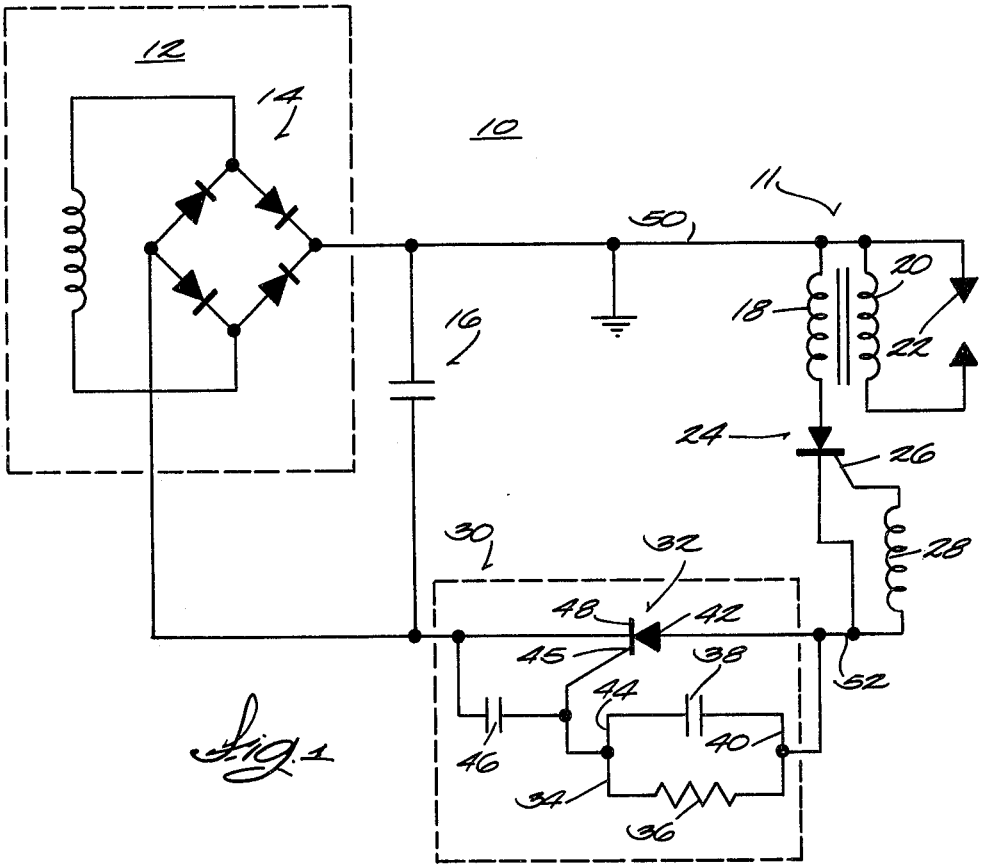
FIG. 1 is a schematic circuit of capacitor discharge ignition system including an isolation circuit and which embodies various of the features of the invention.

Shown in FIG. 1 a capacitor discharge ignition system 10 which embodies various features of the invention. Generally, the system 10 includes a power supply 12 having a full wave diode rectifying bridge 14 which is connected to allow charging of the charge capacitor 16. The system 10 also includes an ignition coil 11 including a primary winding 18 and a secondary winding 20 which causes an ignition spark across the contacts of the spark plug 22 when the charge capacitor 16 discharges through the primary winding 18. The discharge of the charge capacitor 16 is controlled by a suitable switch such as an ignition SCR 24 which is rendered conductive upon application a trigger pulse applied to the gate 26 of the SCR 24 by a trigger coil, designated 28. The preceeding components of the CD ignition system 10 are generally conventional in nature, so that greater detail of description is not necessary for one skilled in the art.

The CD ignition system 10 also includes isolation circuit means, shown in a dashed line box generally designated 30, which is connected in series relationship with charge capacitor 16, the primary winding 18, and the ignition SCR 24. As will be discussed further below, the isolation circuit means 30 is operable for selectively isolating the primary winding 18 and ignition SCR 24 from the charge capacitor 16 to provide for immediate recharging of the charge capacitor after the charge capacitor has discharged through primary winding 18 to effect an ignition spark.

While various isolation circuit means arrangements are possible, in the illustrated preferred embodiment, such means comprises an isolation circuit, also generally designated 30, including a thyristor, preferrably in the form of an "isolation" SCR 32, having an anode-cathode path connected in series relationship with the anode-cathode path of the ignition SCR 24. As shown in the preferred embodiment, the isolation circuit 30 also includes a parallel RC network, generally designated 34, including a resistor 36 and a capacitor 38. The RC network 34 includes one end 40 connected by lead 52 to the isolation SCR anode, designated 42, and includes an opposite end 44 connected to the gate 45 of isolation SCR 32. The isolation circuit 30 preferrably includes another capacitor 46, which is connected between the cathode 48 and the gate 45 of isolation SCR 32 as illustrated, and which functions as an RF filter to prevent false triggering of the SCR 32.

To describe the operation of the CD ignition system 10, it will be assumed that charge capacitor 16 is fully charged and a trigger signal produced by the trigger coil 28 is applied to the gate 26 of the ignition SCR 24. SCR 24 is rendered conductive and turns on so the charge capacitor 16 begins to discharge. At this point the current flowing through primary winding 18 and ignition SCR 24 as a result of the discharge of capacitor 16 also flows through capacitor 38 to trigger the gate 45 of the isolation SCR 32 which is rendered conductive, resulting in the charge capacitor 16 fully discharging with current flowing through the ignition primary winding 18 and the anode-cathode paths of ignition SCR 24 and the isolation SCR 32. This current flow through the primary winding 18 induces a high voltage in the secondary winding 20 to effect an ignition spark across the contacts of spark plug 22. The isolation circuit 30, including the isolation SCR 32, does not cause any apprecible delay in the discharge of charge capacitor 16 through the primary winding 18, and thus, does not effect ignition timing.

When the charge capacitor 16 discharges to near zero voltage (e.g. to 3 or 4 volts) and the current flow through the ignition SCR 24 and the isolation SCR 32 drops to below the holding current value of one of the SCRs (e.g. 20 milliamps) the current flow is cutoff and both SCRs turn off. Due to transient current flow the charge capacitor 16 will continue to discharge going through zero so that a back emf voltage (e.g., 3 volts) appears across capacitor 16. This back emf is limited by the voltage drop of the diodes of the diode bridge 14 of the power supply 12, and helps clamp the isolation SCR 32 off.

Ordinarily, without the provision of the isolation circuit 30, at higher engine rpm, the trigger coil signal produced by the trigger coil 28 might cause the ignition SCR 24 to prematurely turn on again, and leakage voltage from the power supply 12 would flow through the primary winding and ignition SCR, thus preventing the charge capacitor 16 from beginning to recharge immediately after discharge.

With the provision of the isolation circuit 30, however, leakage voltage is prevented, and the charge capacitor begins immediate recharging after discharge. This is because when the isolation SCR 32 turns off it can not be prematurely turned back on, since the gate of the isolation SCR is back biased by the voltage still on the capacitor 38 of the parallel RC network 34. The back bias voltage on the capacitor 38 of the RC network also prevents leakage voltage so that when the isolation SCR 32 turns off, the charge capacitor 16 is isolated from the primary winding and ignition SCR, even though the ignition SCR 24 may be turned back on prematurely. Thus, the charge capacitor 16 immediately begins to recharge after it discharges to effect an ignition spark. As noted, the turn off of the isolation SCR 32 is assisted by the back emf of the charge capacitor 16 which reverse biases or clamps the isolation SCR 32 off. Values of the capacitor 38 and resistor 36 of the RC network 34 are selected so that the isolation SCR 32 remains off to prevent leakage voltage and allow immediate recharging of charge capacitor 16, but not so as to effect ignition timing. For purposes of example only, suitable values for the isolation circuit components are as follows: the isolation SCR 32 and ignition SCR 24 can be identical and 600 volt rated; the capacitor 38, 0.0033 microfarads; capacitor 46, 0.001 microfarads, and resistor 36, 2 megohms. The charge capacitor 16 can have a value of one microfarad.

Generally, the isolation circuit means 30 allows for immediate recharging of the charge capacitor so that a shorter time period between ignition sparks is required for the capacitor to become fully charged. This feature can be utilized with a single cylinder engine, for example, to extend the high engine rpm at which suitable ignition voltage is produced by at least several hundred rpm.

The invention is also useful to maintain suitable ignition voltage for multiple cylinder engines having CD ignition system powered, for example, by a single power supply. FIG. 2 shows a portion of a CD ignition system **10*a*, modified from that shown in FIG. 1 to include four sets of ignition coils, spark plugs, trigger coils, and ignition SCRs, for operation with a four cylinder engine. The remainder of the ignition system 10*a* is not shown, but it is to be understood that it is the same as the CD ignition system 10, except that four sets of ignition coils, spark plugs, trigger coils, and ignition SCRs are connected to leads labelled 50 and 52, instead of the one set shown in FIG. 1. Components in FIG. 2 are labelled with the same numberals as corresponding components in FIG. 1**.

Without the isolation circuit means 30, a four cylinder CD ignition system with a single power supply might begin to become speed limited at, for example, 4000 rpm, at which point the periods between ignition sparks would be too short to allow full charging of the capacitor and the ignition voltage would start to go down. At an engine speed of for example, 5500 rpm, there might be insufficient voltage to effect ignition.

With the isolation circuit means 30, the four cylinder CD ignition system with a single power supply can remain operative at a relatively higher rpm, for example, 6500 rpm, and still have suitable voltage to effect ignition. As noted, the isolation circuit means 30 allows immediate recharging of the charge capacitor so that a shorter time period between ignition sparks is required to fully charge the charge capacitor. Thus, by utilizing the isolation circuit means of the present invention, useable engine rpm can be increased before engine operation becomes speed limited, due to insufficient ignition voltage.

In view of the above description, it should be appreciated that the isolation circuit 30 could also be located on the ground side of the ignition system 10, with the anode 42 of the isolation SCR 32 connected to ground, and the cathode 48 connected to the ground side of the primary winding 18. Accordingly, it is to be understood the invention is not confined to the particular construction and arrangement of components as herein illustrated and described, but embraces all such modified forms thereof as come within the scope of the following claims.

I claim:

1. An isolation circuit adapted for use with a capacitor discharge ignition system including a charge capacitor, an ignition coil primary winding, and an ignition SCR, said isolation circuit comprising a thyristor having a gate, an anode and a cathode, said thyristor having an anode-cathode path adapted for connection in series relationship with the charge capacitor, the primary winding and the ignition SCR, said isolation circuit further comprising a parallel RC network having one end connected to said thyristor anode and having an opposite end connected to said thyristor gate, said isolation circuit providing for immediate recharging of the charge capacitor after the charge capacitor has discharged through the primary winding to effect an ignition spark.

2. An isolation circuit in accordance with claim 1, further comprising a capacitor having one end connected to said thyristor cathode and having an opposite end connected to said thyristor gate to prevent false triggering of said thyristor.

3. A capacitor discharge ignition circuit adapted for connection to an ignition coil primary winding, said circuit comprising a charge capacitor, an ignition SCR, and isolation circuit means for connecting said charge capacitor and said ignition SCR in series relationship with said primary winding and operative for selectively isolating the primary winding and said ignition SCR from said charge capacitor to provide for immediate recharging of said charge capacitor after said charge capacitor has discharged through said primary winding to effect an ignition spark, said isolation circuit means comprising a thyristor having an anode, a cathode, and a gate, and having an anode-cathode path connected in series relationship with said charge capacitor and said ignition SCR, said isolation circuit means further comprising a parallel RC network having one end connected to said thyristor anode and having an opposite end connected to said thyristor gate.

4. A capacitor discharge ignition circuit in accordance with claim 3, wherein said isolation circuit means further comprises a capacitor having one end connected to said thyristor cathode and an opposite end connected to said thyristor gate to prevent false triggering of said thyristor.

5. A capacitor discharge ignition system comprising a charge capacitor, an ignition coil primary winding, an ignition SCR, and isolation circuit means connected in series relationship with said charge capacitor, said primary winding and said ignition SCR, said isolation circuit means being operative for selectively isolating said primary winding and said ignition SCR from said charge capacitor to provide for immediate recharging of said charge capacitor after said charge capacitor has discharged through said primary winding to effect an ignition spark, said isolation circuit means comprising a thyristor having an anode, a cathode, and a gate and having an anode-cathode path connected in series relationship with said charge capacitor and said ignition SCR, said isolation circuit means further comprising a parallel RC network having one end connected to said thyristor anode and having an opposite end connected to said thyristor gate.

6. A capacitor discharge ignition system in accordance with claim 5, wherein said isolation circuit means further comprises a capacitor having one end connected to said thyristor cathode and an opposite end connected to said thyristor gate to prevent false triggering of said thyristor.

7. A capacitor discharge ignition system in accordance with claim 5, wherein said ignition SCR includes a cathode connected to said thyristor anode.

8. A capacitor discharge ignition system in accordance with claim 5 further comprising a power supply including a full-wave diode rectifying bridge having its output terminals connected across said charge capacitor.

9. A capacitor discharge ignition system for a four cylinder engine comprising a charge capacitor, a power supply including a full-wave diode rectifying bridge having its output terminals connected across said charge capacitor, four sets of ignition components, each set including an ignition coil primary winding, and an ignition SCR, said system further comprising isolation circuit means connected in series relationship with said charge capacitor, and operative for selectively isolating said charge capacitor from said primary windings and said ignition SCRs to provide for immediate recharging of said charge capacitor after said charge capacitor has discharged through one of said primary windings to effect an ignition spark, said isolation circuit means comprising a thyristor having an anode, a cathode, and a gate, and having an anode-cathode path connected in series relationship with said charge capacitor, said isolation circuit means further comprising a parallel RC network having one end connected to said thyristor anode and having an opposite end connected to said thyristor gate.

10. An isolation circuit adapted for use with a capacitor discharge ignition system including a charge capacitor, an ignition coil primary winding, and an ignition SCR, said isolation circuit comprising a thyristor having a gate, an anode and a cathode, said thyristor having an anode-cathode path adapted for connection in series relationship with the charge capacitor, the primary winding and the ignition SCR, said isolation circuit being operative for selectively isolating the primary winding and said ignition SCR from said charge capacitor to provide for immediate recharging of the charge capacitor after the charge capacitor has discharged through the primary winding to effect an ignition spark.

11. A capacitor discharge ignition circuit adapted for connection to an ignition coil primary winding, said circuit comprising a charge capacitor, an ignition SCR, and isolation circuit means comprising a thyristor having an anode, a cathode, and a gate, and having an anode-cathode path connected in series relationship with said charge capacitor and said ignition SCR, said isolation circuit means being operative for selectively isolating the primary winding and said ignition SCR from said charge capacitor to provide for immediate recharging of said charge capacitor after said charge capacitor has discharged through said primary winding to effect an ignition spark.

12. A capacitor discharge ignition system comprising a charge capacitor, an ignition coil primary winding, an ignition SCR, and isolation circuit means comprising a thyristor having an anode, a cathode, and a gate and having an anode-cathode path connected in series relationship with said charge capacitor and said ignition SCR, said isolation circuit means being operative for selectively isolating said primary winding and said ignition SCR from said charge capacitor to provide for immediate recharging of said charge capacitor after said charge capacitor has discharged through said primary winding to effect an ignition spark.

* * * * *